US007420533B2

(12) United States Patent
Yun

(10) Patent No.: US 7,420,533 B2
(45) Date of Patent: Sep. 2, 2008

(54) LIQUID CRYSTAL DISPLAY AND DRIVING METHOD THEREOF

(75) Inventor: Sang Chang Yun, Taegu-shi (KR)

(73) Assignee: LG Display Co., Ltd., Seoul (KR)

( * ) Notice: Subject to any disclaimer, the term of this patent is extended or adjusted under 35 U.S.C. 154(b) by 1014 days.

(21) Appl. No.: 10/183,445

(22) Filed: Jun. 28, 2002

(65) Prior Publication Data

US 2003/0189537 A1 Oct. 9, 2003

(30) Foreign Application Priority Data

Apr. 8, 2002 (KR) ..... 10-2002-0018936

(51) Int. Cl.
*G09G 3/36* (2006.01)

(52) U.S. Cl. ..... 345/96; 345/92; 345/100; 345/99; 345/209

(58) Field of Classification Search ..... 345/87–103, 345/208–210, 204–205
See application file for complete search history.

(56) References Cited

U.S. PATENT DOCUMENTS 5,093,655 A * 3/1992 Tanioka et al. ..... 345/96
5,253,091 A * 10/1993 Kimura et al. ..... 345/94
5,774,099 A * 6/1998 Iwasaki et al. ..... 345/87
5,790,092 A * 8/1998 Moriyama ..... 345/96
6,075,505 A * 6/2000 Shiba et al. ..... 345/87
6,429,842 B1 * 8/2002 Shin et al. ..... 345/92
6,512,505 B1 * 1/2003 Uchino et al. ..... 345/96
6,552,707 B1 * 4/2003 Fujiyoshi ..... 345/98
2001/0011981 A1 * 8/2001 Yamamoto et al. ..... 345/87

FOREIGN PATENT DOCUMENTS

JP 4-309926 * 11/1992
JP 0558059 A2 * 1/1993
KR 1999-80838 11/1999

* cited by examiner

*Primary Examiner*—Lun-Yi Lao
(74) *Attorney, Agent, or Firm*—McKenna Long & Aldridge LLP

(57) ABSTRACT

A liquid crystal display and a dot inversion driving technique for that liquid crystal display. The liquid crystal display includes a liquid crystal display panel having liquid crystal cells defined by intersections of gate and data lines. Each liquid crystal cell includes a thin film transistor. Those thin film transistors are connected in a zigzag pattern to the gate lines. Pixel voltage signals are applied in a line inversion fashion to the liquid crystal cells such that the pixel voltage signal polarities (referenced to a common electrode) are inverted in every horizontal period. The common electrode can be an AC voltage that changes in each horizontal period.

22 Claims, 10 Drawing Sheets

FIG.2A
CONVENTIONAL ART

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

FIG.2B
CONVENTIONAL ART

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

FIG.3A
CONVENTIONAL ART

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

FIG.3B
CONVENTIONAL ART

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

FIG.4A
CONVENTIONAL ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG.4B
CONVENTIONAL ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

LIQUID CRYSTAL DISPLAY AND DRIVING METHOD THEREOF

BACKGROUND OF THE INVENTION

This application claims the benefit of Korean Patent Application No. P2002-18936, filed on Apr. 8, 2002, which is hereby incorporated by reference for all purposes as if fully set forth herein.

FIELD OF THE INVENTION

This invention relates to liquid crystal displays, and more particularly to a liquid crystal display that is driven by dot inversion by means of a data driver driven by line inversion.

DESCRIPTION OF THE RELATED ART

Generally, a liquid crystal display (LCD) controls the light transmittance of liquid crystal cells in accordance with video signals to produce an image. To this end, an LCD includes a liquid crystal display panel having liquid crystal cells that are arranged in a matrix, and a driving circuit for driving the liquid crystal display panel.

In a liquid crystal display panel, gate lines and data lines are arranged in a crossing manner. Each liquid crystal display cell is provided with a pixel electrode and a common electrode for applying an electric field across a liquid crystal. Each pixel electrode is connected, via source and drain electrodes of a thin film transistor that acts as a switching device, to one of data lines. The gate electrode of each thin film transistor is connected to one of the gate lines. This enables pixel voltage signals to be applied to the pixel electrodes.

The driving circuit includes a gate driver for driving the gate lines, a data driver for driving the data lines, and a common voltage generator for driving the common electrode. The gate driver sequentially applies scanning signals, that is, a gate signal to the gate lines, that sequentially drives the liquid crystal cells of the liquid crystal display panel line by line. The data driver selectively applies pixel voltage signals to the data lines whenever a gate signal is applied to any one of the gate lines. The common voltage generator applies a common voltage signal to the common electrode. Accordingly, the LCD allows the arrangements of a liquid crystal between the pixel electrodes and the common electrode to be changed in accordance with the pixel voltage signal for each liquid crystal cell so as to control the light transmittance of each liquid crystal cell, thereby producing an image.

For instance, as shown in FIG. 1, a liquid crystal display includes a liquid crystal display panel 2 having liquid crystal cells arranged in a matrix, a gate driver 4 for driving gate lines GL1 to GLn, and a data driver 6 for driving data lines DL1 to DLm. In FIG. 1, the liquid crystal display panel 2 includes thin film transistors (TFT's), each of which are provided at intersections between the n gate lines (GL1 to GLn) and the m data lines (DL1 to DLm). Each TFT applies a video signal from the data line (DL1 to DLm) to its associated liquid crystal cell in response to a gate signal from the gate lines (GL1 to GLn). Each liquid crystal cell represents and equivalent liquid crystal capacitor Clc because each liquid crystal cell includes a common electrode, an opposed pixel electrode, and liquid crystal disposed between those electrodes. Furthermore, each liquid crystal cell is provided with a storage capacitor (not shown) for maintaining the data voltage that is charged into the liquid crystal capacitor Clc until the next data voltage signal is applied. The storage capacitor usually includes the pixel electrode overlapped with a prestage gate electrode.

The gate driver 4 sequentially applies scanning signals, that is, gate signals, to each of the gate lines (GL1 to GLn) so as to drive the TFTs connected to a driven gate line. The data driver 6 coverts pixel data into analog pixel voltage signals that are applied to the data lines DL1 to DLm every horizontal period when a gate signal is applied to the gate line GL. In this case, the data driver 6 converts pixel data into pixel voltage signals with the aid of gamma voltages for each gray scale level supplied from a gamma voltage generator (which is not shown).

In order to drive the liquid crystal cells of the liquid crystal display panel 2, such a liquid crystal display uses an inversion driving method. Such driving methods include frame inversion, line (or column) inversion, or dot inversion.

In frame inversion, the polarities of the pixel voltage signals that applied to the liquid crystal cells are inverted in every frame. The reason for doing this is to prevent liquid crystal deterioration.

In line inversion, the polarities of the pixel voltage signals are inverted in every gate line and in every frame, reference FIG. 2A and FIG. 2B, respectively. Line inversion driving systems have a problem in that crosstalk between horizontal lines can cause a flicker that manifests itself as a horizontal stripe pattern.

In column inversion, the polarities of the pixel voltage signals are inverted in every data line and in every frame, reference FIG. 3A and FIG. 3B, respectively. Column inversion driving systems have a problem in that crosstalk between vertical columns can cause a flicker that manifests itself as a vertical stripe pattern.

In dot inversion, the polarities of the pixel voltage signals of adjacent pixels are opposite and are inverted in every frame, reference FIG. 4A and FIG. 4B. More specifically, when video signals in odd-numbered frames are being displayed, the pixel voltage signals applied to the liquid crystal cells are such that positive (+) polarity and negative (−) polarity alternate, starting from the upper left liquid crystal cell toward the bottom right liquid crystal cell, reference FIG. 4A. When video signals in the even-numbered frames are displayed, the pixel voltage signals are such that a negative (−) polarity and a positive (+) polarity alternate from the top left liquid crystal cell toward the bottom right liquid crystal cell, reference FIG. 4B. Such a dot inversion driving system provides improved picture quality.

However, dot inversion has a disadvantage in that, since the polarities of the pixel voltage signals are inverted both horizontally and vertically, the frequency of the pixel voltage signals are relatively large, causing an increase in power consumption in comparison to other inversion systems. Therefore, an improved dot inversion technique would be beneficial.

SUMMARY OF THE INVENTION

Accordingly, it is an object of the present invention to provide an improved dot inversion technique.

Accordingly, it is another object of the present invention to provide a liquid crystal display and driving method wherein a liquid crystal display panel can be driven in a dot inversion system by means of a data driver driven by line inversion system, thereby dramatically reducing power consumption.

In order to achieve these and other objects of the invention, a liquid crystal display according to one aspect of the present invention includes a liquid crystal display panel having liquid crystal cells provided at each area defined by intersections between gate lines and data lines. The liquid crystal display further includes thin film transistors that are arranged in a zigzag pattern around each of the gate lines, and a liquid crystal display panel driver for applying pixel voltage signals to the liquid crystal cells by line inversion. This enables the polarities of the pixel voltage signals to be inverted in every horizontal period, thereby driving the liquid crystal cells by dot inversion.

In the liquid crystal display, odd-numbered liquid crystal cells of the ith horizontal line (wherein i is an integer) are connected to the ith gate line, while even-numbered liquid crystal cells of the ith horizontal line are connected to the (i+1)th gate line.

Otherwise, even-numbered liquid crystal cells of the ith horizontal line (wherein i is an integer) are connected to the ith gate line, while odd-numbered liquid crystal cells of the ith horizontal line are connected to the (i+1)th gate line.

The liquid crystal display panel driver includes a gate driver for sequentially driving gate lines; a data driver for converting input pixel data into said pixel voltage signals using a line inversion system that applies the pixel data to the data lines; a common voltage generator for supplying a common voltage that is a reference voltage of the liquid crystal cell; and a timing controller for controlling the gate driver and the data driver and for combining the pixel data in the current horizontal period with the pixel data in the previous horizontal period so as to apply combined pixel data to the data driver in every horizontal period.

The timing controller combines odd-numbered pixel data for one horizontal line with even-numbered pixel data that is delayed by one horizontal period, and then applies the combined pixel data to the data driver in every horizontal period.

Alternatively, the timing controller combines even-numbered pixel data for one horizontal line with odd-numbered pixel data that is delayed by one horizontal period, and then applies the combined pixel data to the data driver every horizontal period.

The liquid crystal display panel driver further includes a gate driver for sequentially driving the gate lines; a data driver for combining pixel data in the current horizontal period with pixel data in a previous horizontal period to produce combined pixel data represented by pixel voltage signals that are applied by line inversion to the data lines in every horizontal period; a common voltage generator for supplying a common voltage that is a reference voltage for the liquid crystal cells; and a timing controller for controlling the gate driver and the data driver and for supplying the pixel data to the data driver.

Herein, the data driver combines odd-numbered pixel data of one horizontal line with even-numbered pixel data delayed by one horizontal period to produce combined pixel data that is applied to the data lines in every horizontal period.

Otherwise, the data driver combines even-numbered pixel data of one horizontal line with odd-numbered pixel data delayed by one horizontal period to produce combined pixel data that is applied to the data lines in every horizontal period.

The data driver includes a shift register array for applying sequential sampling signals; a latch array for latching and outputting pixel data in response to the sampling signals; a digital-to-analog converter array for converting pixel data into pixel voltage signals; a buffer array for buffering and outputting said pixel voltage signals; and a delay array, being connected to an output terminal of the latch array, or to the digital-to-analog converter array, or to the buffer array, the delay array for delaying the odd-numbered or the even-numbered pixel data for one horizontal line by one horizontal period.

The liquid crystal display panel driver includes a gate driver for sequentially driving the gate lines; a data driver for converting input pixel data into pixel voltage signals that are applied to the data lines; a common voltage generator for supplying an AC common voltage that is a reference voltage for the liquid crystal cells; and a timing controller for controlling the gate driver and the data driver and for combining pixel data in the current horizontal period with pixel data in the previous horizontal period to produce combined pixel data that is applied to the data driver in every horizontal period.

Alternatively, the liquid crystal display panel driver includes a gate driver for sequentially driving the gate lines; a data driver for combining pixel data in the current horizontal period with pixel data in the previous horizontal period so as to produce combined pixel data that is applied to the data lines in every horizontal period; a common voltage generator for supplying an AC common voltage that acts as a reference voltage for the liquid crystal cells; and a timing controller for controlling the gate driver and the data driver and for applying the pixel data to the data driver.

A method of driving a liquid crystal display according to another aspect of the present invention includes the steps of combining pixel data in the current horizontal period with pixel data in the previous horizontal period to produce combined pixel data in every horizontal period; and applying the combined pixel data to liquid crystal cells, which include thin film transistors arranged in a zigzag pattern around a corresponding gate line, using line inversion, thereby driving the liquid crystal cells by dot inversion.

In the method, if odd-numbered liquid crystal cells on the ith horizontal line (wherein i is an integer) and even-numbered liquid crystal cells on the (i+1)th horizontal line are connected to the ith gate line, then the step of combining the pixel data includes combining odd-numbered pixel data of with even-numbered pixel data delayed by one horizontal period.

Otherwise, if even-numbered liquid crystal cells on the ith horizontal line (wherein i is an integer) and odd-numbered liquid crystal cells on the (i+1)th horizontal line are connected to the ith gate line, then the step of combining pixel data includes combining even-numbered pixel data of the current horizontal line with odd-numbered pixel data delayed by one horizontal period.

BRIEF DESCRIPTION OF THE DRAWINGS

These and other objects of the invention will be apparent from the following detailed description of the embodiments of the present invention with reference to the accompanying drawings, in which:

FIG. 2A and FIG. 2B are views for explaining a line inversion driving system;

FIG. 3A and FIG. 3B are views for explaining a column inversion driving system;

FIG. 4A and FIG. 4B are views for explaining a dot inversion driving system;

DETAILED DESCRIPTION OF THE PREFERRED EMBODIMENT

Figure 1:
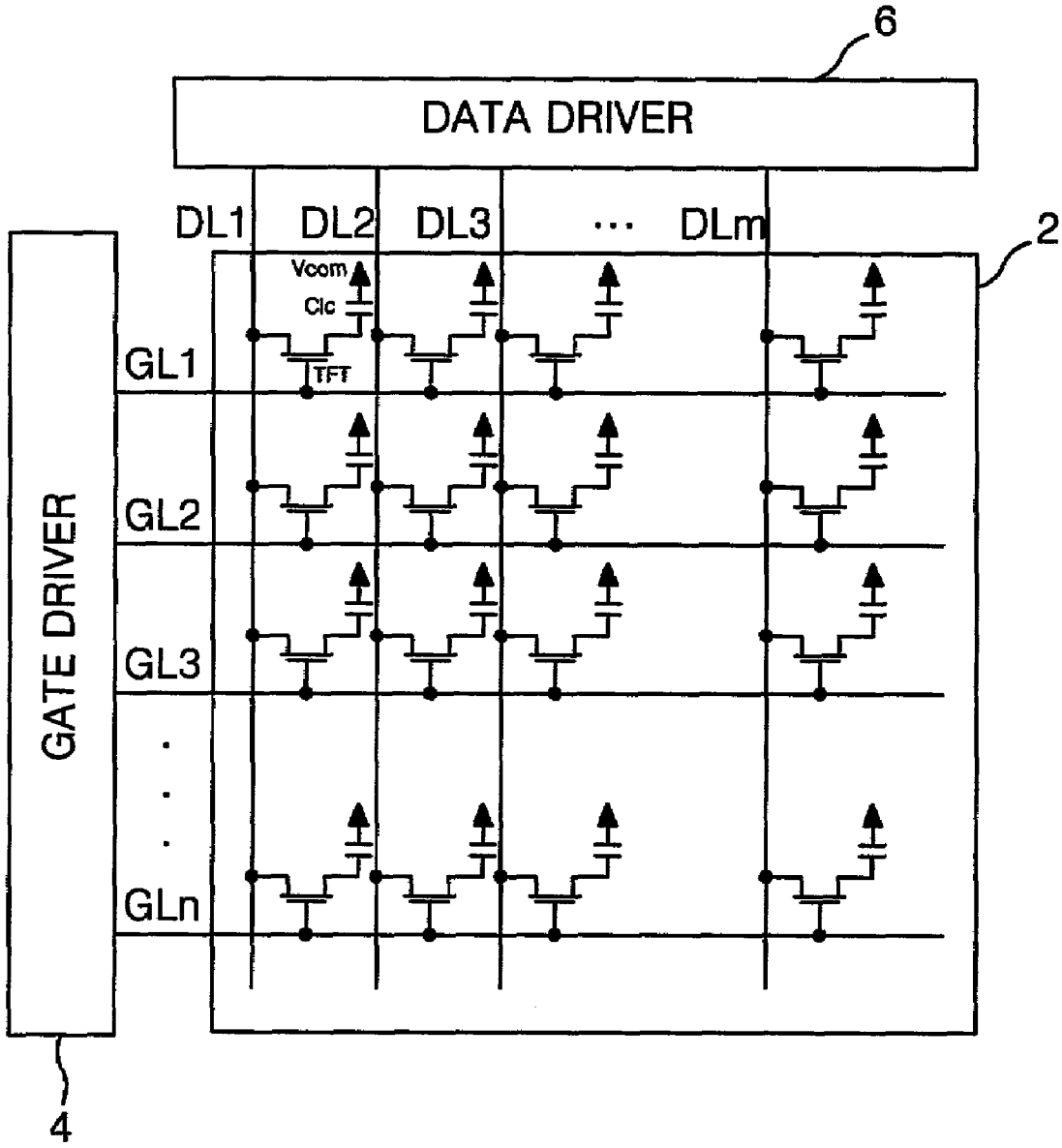
FIG. 1 CONVENTIONAL ART
FIG. 1 is a schematic view showing a configuration of a conventional liquid crystal display.
Figure 5:
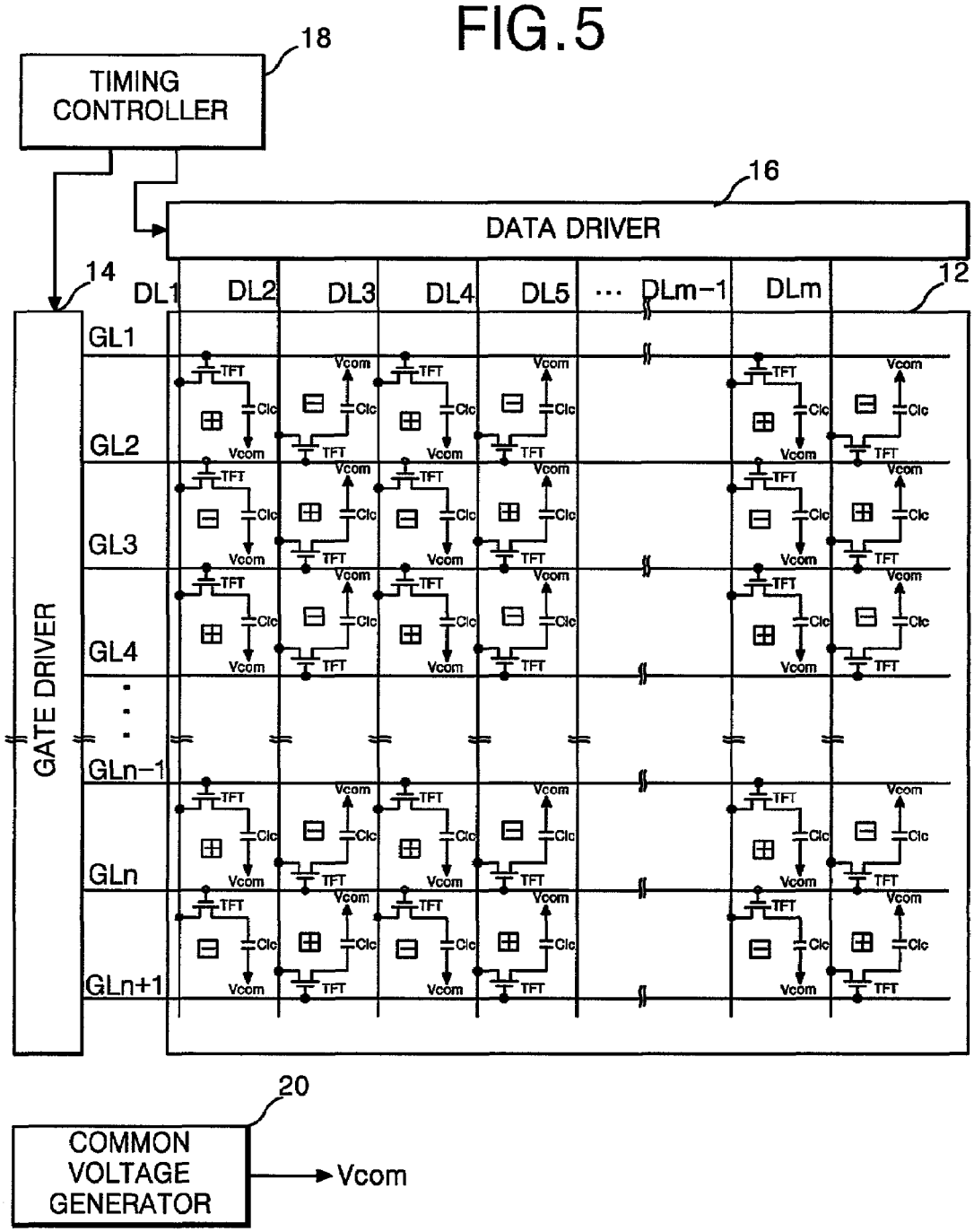
FIG. 5 is a schematic view showing liquid crystal display according to an embodiment of the present invention.

Referring now to FIG. 5, there is shown a liquid crystal display according to an embodiment of the present invention. The liquid crystal display includes a liquid crystal display panel 12 having liquid crystal cells arranged in a matrix, a gate driver 14 for driving gate lines GL1 to GLn+1, a data driver 16 for driving data lines DL1 to DLm of, a timing controller 18 for controlling the gate driver 14 and the data driver 16, and a common voltage generator 20 for applying a common voltage Vcom to the liquid crystal display panel 12.

As shown the liquid crystal display panel 12 includes a plurality of crossing gate lines (GL1 to GLn+1) and data lines (DL1 to DLm) (which are insulated from the gate lines GL1 to GLn+1). Liquid crystal cells are provided at areas defined by intersections between the gate lines (GL1 to GLn+1) and the data lines (DL1 to DLm). Each liquid crystal cell includes a thin film transistor (TFT) that is connected to one of the gate lines (GL1 to GLn+1) and to one of the data lines (DL1 to DLm). A liquid crystal capacitor Clc comprised of a common electrode, a pixel electrode, and a liquid crystal is connected to the TFT. Each liquid crystal cell further includes a storage capacitor (not shown) for maintaining a data voltage that is charged in the liquid crystal capacitor Clc until the next data voltage is applied.

The TFT applies a pixel voltage signal from a corresponding data line DL in response to a scanning signal, that is, a gate signal, from the corresponding gate line GL. Particularly, the TFT's are arranged in a zigzag pattern along the gate lines GL1 to GLn+1. Thus, the liquid crystal cells driven by the gate lines (GL1 to GLn+1) also are arranged in a zigzag pattern around the corresponding gate lines (GL1 to GLn+1). In other words, adjacent liquid crystal cells in a horizontal row are arranged so as to be driven by different gate lines. As a result, liquid crystal cells in adjacent horizontal lines are driven whenever a single gate line (GL1 to GLn+1) is driven. Furthermore, each horizontal row is driven with two gate lines. To this end, the nth gate line (GLn) is followed by the (n+1) gate line (GLn+1).

More specifically, the liquid crystal cells at the odd columns, which are connected to the odd-numbered data lines DL1, DL3, . . . , DLm−1, are driven by an upper gate line (GL1 to GLn) while the liquid crystal cells in the even columns, which are connected to the even-numbered data lines DL2, DL4, . . . , DLm, are driven by a lower adjacent gate lines GL2 to GLn+1. In other words, the liquid crystal cells in the ith horizontal row that are connected to the odd numbered columns are driven by the ith gate line Gli, while the liquid crystal cells in the ith horizontal row that are connected to the even numbered columns are driven by the (i+1)th gate line GLi+1.

For instance, the liquid crystal cells in the first horizontal row that are connected to odd numbered columns are driven by gate line GL1, while the liquid crystal cells in the first horizontal row that are connected to even numbered columns are driven by gate line GL2. Furthermore, liquid crystal cells in the nth horizontal row that are connected to the odd numbered columns are driven with the nth gate line GLn while liquid crystal cells in the nth horizontal row that are connected to the even numbered columns are driven by the (n+1)th gate line GLn+1.

Liquid crystal cells thus arranged are driven by dot inversion when the pixel voltage signals are applied by line inversion. For instance, referring now to the pixel polarities shown in FIG. 5 and to the foregoing description of line inversion and to the operation of a liquid crystal panel, when the first gate line GL1 is driven in one frame interval, positive (+) pixel voltage signals are applied to the odd-numbered liquid crystal cells on the first horizontal line. Further, when the second gate line GL2 is driven, negative (−) pixel voltage signals are charged in both the even-numbered liquid crystal cells on the first horizontal line and the odd-numbered liquid crystal cells on the second horizontal line. Furthermore, when the third gate line GL3 is driven, positive (+) pixel voltage signals are charged in both the even-numbered liquid crystal cells on the second horizontal line and the odd-numbered liquid crystal cells on the third horizontal line. Accordingly, since positive (+) pixel voltage signals, negative (−) pixel voltage signals, negative (−) pixel voltage signals and positive (+) pixel voltage signals are charged in the odd-numbered liquid crystal cells on the first horizontal line, the even-numbered liquid crystal cells on the first horizontal line, the odd-numbered liquid crystal cells on the second horizontal line and the even-numbered liquid crystal cells on the second horizontal line, respectively, the liquid crystal display panel 12 is driven by dot inversion.

Figure 6:
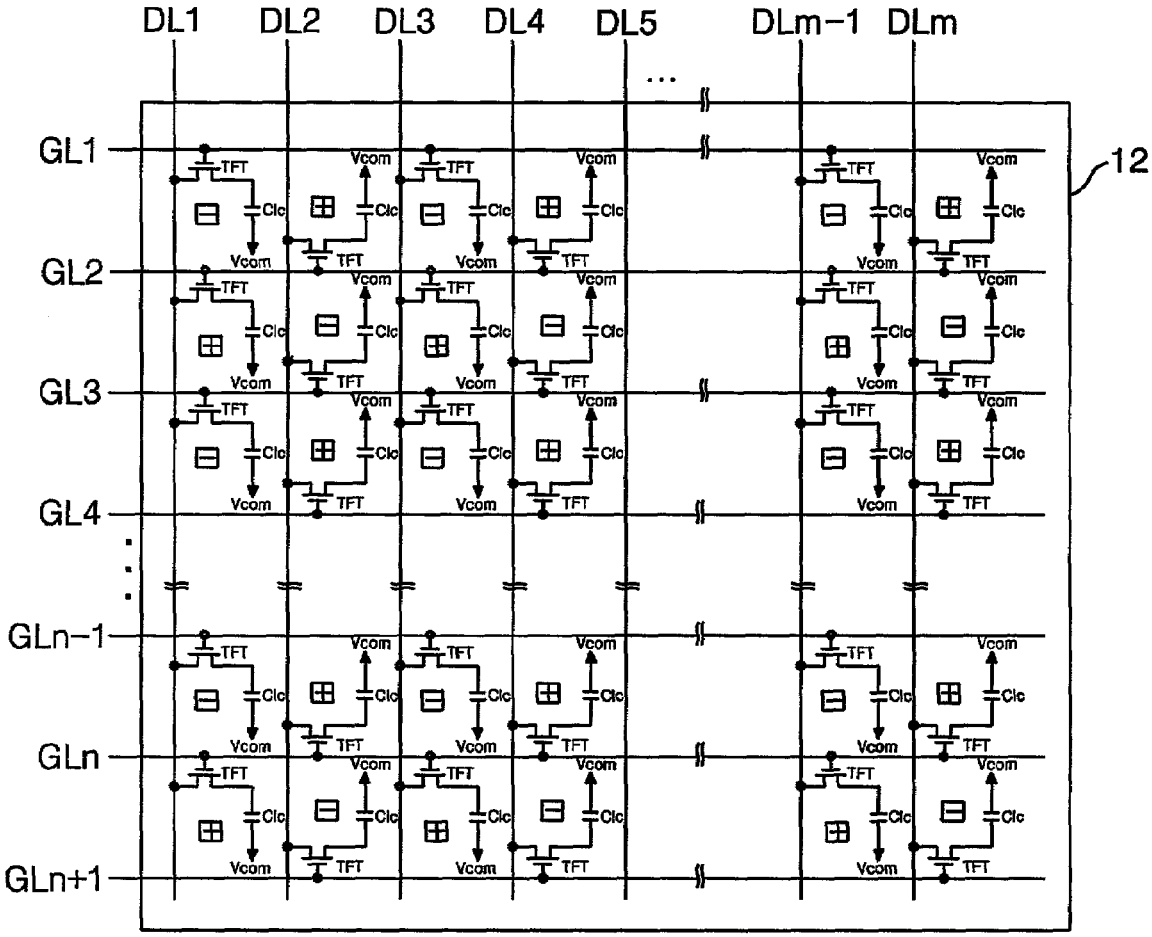
FIG. 6 is a schematic view showing another configuration of a liquid crystal display according to an embodiment of the present invention.

Subsequently, referring now to the pixel polarities shown in FIG. 6, in the next frame the polarities are reversed. When the first gate line GL1 is driven negative (−) pixel voltage signals are charged in the odd-numbered liquid crystal cells on the first horizontal line. Further, when the next second gate line GL2 is driven, positive (+) pixel voltage signals are charged in both the even-numbered liquid crystal cells on the first horizontal line and the odd-numbered liquid crystal cells on the second horizontal line. Furthermore, when the third gate line GL3 is driven, negative (−) pixel voltage signals are charged in both the even-numbered liquid crystal cells on the second horizontal line and the odd-numbered liquid crystal cells on the third horizontal line. Accordingly, since negative (−) pixel voltage signals, positive (+) pixel voltage signals, positive (+) pixel voltage signals and negative (−) pixel voltage signals are charged in the odd-numbered liquid crystal cells on the first horizontal line, the even-numbered liquid crystal cells on the first horizontal line, the odd-numbered liquid crystal cells on the second horizontal line and the even-numbered liquid crystal cells on the second horizontal line, respectively, the liquid crystal display panel 12 is driven by dot inversion.

Referring once again to FIG. 5, the gate driver 14 sequentially applies gate signals, that is, a gate high voltage to the gate lines GL1 to GLn+1 to drive the TFT's connected to the corresponding data line. The data driver 16 converts input pixel data into analog pixel voltage signals that are applied to the data lines (DL1 to DLm) in every horizontal period when a gate high voltage is applied to one of the gate lines (GL1 to GLn+1). The data driver 16 converts the pixel data into pixel voltage signals with the aid of gamma voltages from a gamma voltage generator (not shown). Further, the data driver 16 applies pixel voltage signals having different polarities in every horizontal period by the line inversion system to the data lines (DL1 to DLm).

Particularly, the data driver 16 should apply pixel voltage signals to the liquid crystal cells arranged in a zigzag pattern around a corresponding gate line in every horizontal period. To this end, the data driver 16 receives odd-numbered (or even-numbered) pixel data from the current horizontal period and even-numbered (or odd-numbered) pixel data from the previous horizontal period from the timing controller 18 in every horizontal period.

The timing controller 18 generates control signals for providing a drive control of the gate driver 14 and the data driver 16, and supplies pixel data signals to the data driver 16. Particularly, the timing controller 18 divides pixel data for one horizontal line into odd-numbered pixel data and even-numbered pixel data, and delays the even-numbered (or the odd-numbered) pixel data by one horizontal period. Then, the timing controller 18 combines the delayed even-numbered (or the odd-numbered) pixel data with odd-numbered (or the even-numbered) pixel data for the next horizontal line to output combined pixel data to the data driver 16. In other words, the timing controller 18 supplies odd-numbered (or the even-numbered) pixel data in the current horizontal period and even-numbered (or the odd-numbered) pixel data from the previous horizontal period to the data driver 16 in every horizontal period. A detailed configuration of the timing controller 18 will be described subsequently.

The common voltage generator 20 generates a common voltage Vcom that is applied to the common electrode, which opposes the pixel electrodes. Particularly, in order to charge pixel voltage signals into the liquid crystal cells by line inversion, the data driver 16 supplies pixel voltage signals having the same polarity without polarity inversion in every horizontal period, but provides an AC drive common voltage Vcom that changes polarity in every horizontal period, reference FIG. 7.

Figure 7:
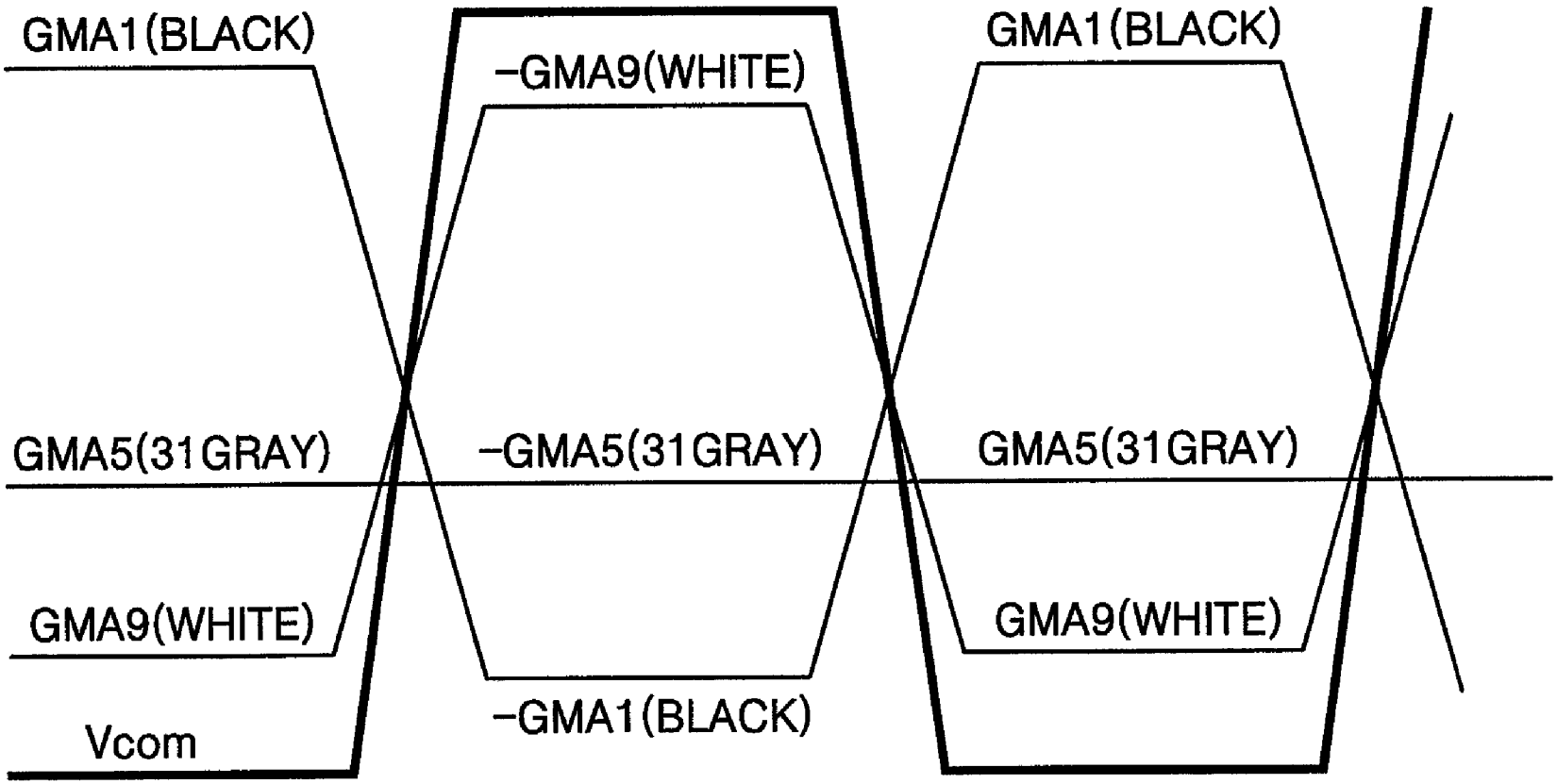
FIG. 7 illustrates the gamma voltage and the common voltage of the embodiment shown in FIG. 5.

Accordingly, the data driver 16 requires only positive gamma voltages, such as gamma voltages GMA1, GMA5 and GMA9, reference FIG. 7. The gamma voltages GMA1, GMA5 and GMA9 correspond to a black gray, a gray, and a white gray, respectively. Thus, analog power consumption can be reduced. Also, the data driver 16 does not require a negative voltage source VDD to produce a lower data driving voltage, thus enabling a cost reduction in the data driver 16 and power supplies.

Figure 8:
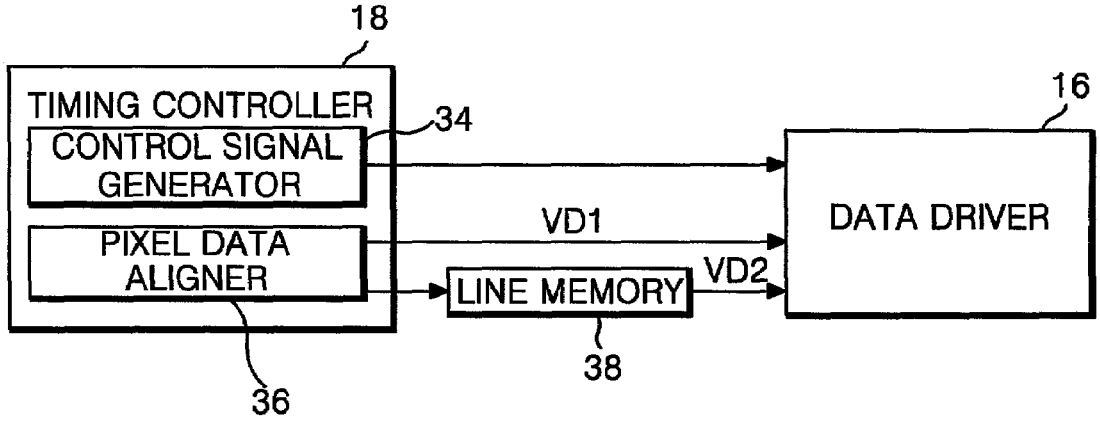
FIG. 8 is a detailed block diagram of the timing controller shown in FIG. 5.

FIG. 8 shows a detailed configuration of the timing controller 18 used FIG. 5. The timing controller 18 includes a control signal generator 34 for generating control signals, a pixel data aligner 36 for re-arranging input pixel data that is applied to the data driver 16, and a line memory 38 that is connected to partial output lines of the pixel data aligner 36 and the data driver 16.

The control signal generator 34 generates gate control signals (i.e., GSP, GOE and GSC, etc.) for controlling the gate driver 14, and data control signals (i.e., SSP, SSC and SOE, etc.) for controlling the data driver 16. Additional input synchronizing signals (i.e., V, H and MCLK, etc.) are usually required. The pixel data aligner 36 aligns input pixel data to divide them into odd-numbered (or even-numbered) pixel data VD1 and even-numbered (or odd-numbered) pixel data VD2. The line memory 38 stores the even-numbered (or the odd-numbered) pixel data VD2 from the pixel data aligner 36 to enable delay the pixel data VD2 by one horizontal period.

Accordingly, the data driver 16 converts the odd-numbered (or the even-numbered) pixel data VD1 from the pixel data aligner 36 and the even-numbered (or the odd-numbered) pixel data VD2, which is delayed by one horizontal period by the line memory 38, into pixel voltage signals in response to a control signal from the control signal generator 34. The result is combined pixel voltage signals for the liquid crystal panel 12.

As described above, a liquid crystal display according to the embodiment of the present invention combines odd-numbered (or even-numbered) pixel voltage signals in a horizontal period with even-numbered (or odd-numbered) pixel voltage signals from the previous horizontal period to produce combined pixel voltage signals that enable liquid crystal cells arranged in a zigzag pattern around gate lines to be driven by line inversion in every horizontal period, thereby driving the liquid crystal display panel 12 by dot inversion. Accordingly, a liquid crystal display according to the principles of the present invention is driven by dot inversion system using driving devices (i.e., the timing controller 18, the data driver 16 and the common voltage generator 20) that produce line inversion. Such can dramatically reducing power consumption.

Figure 9:
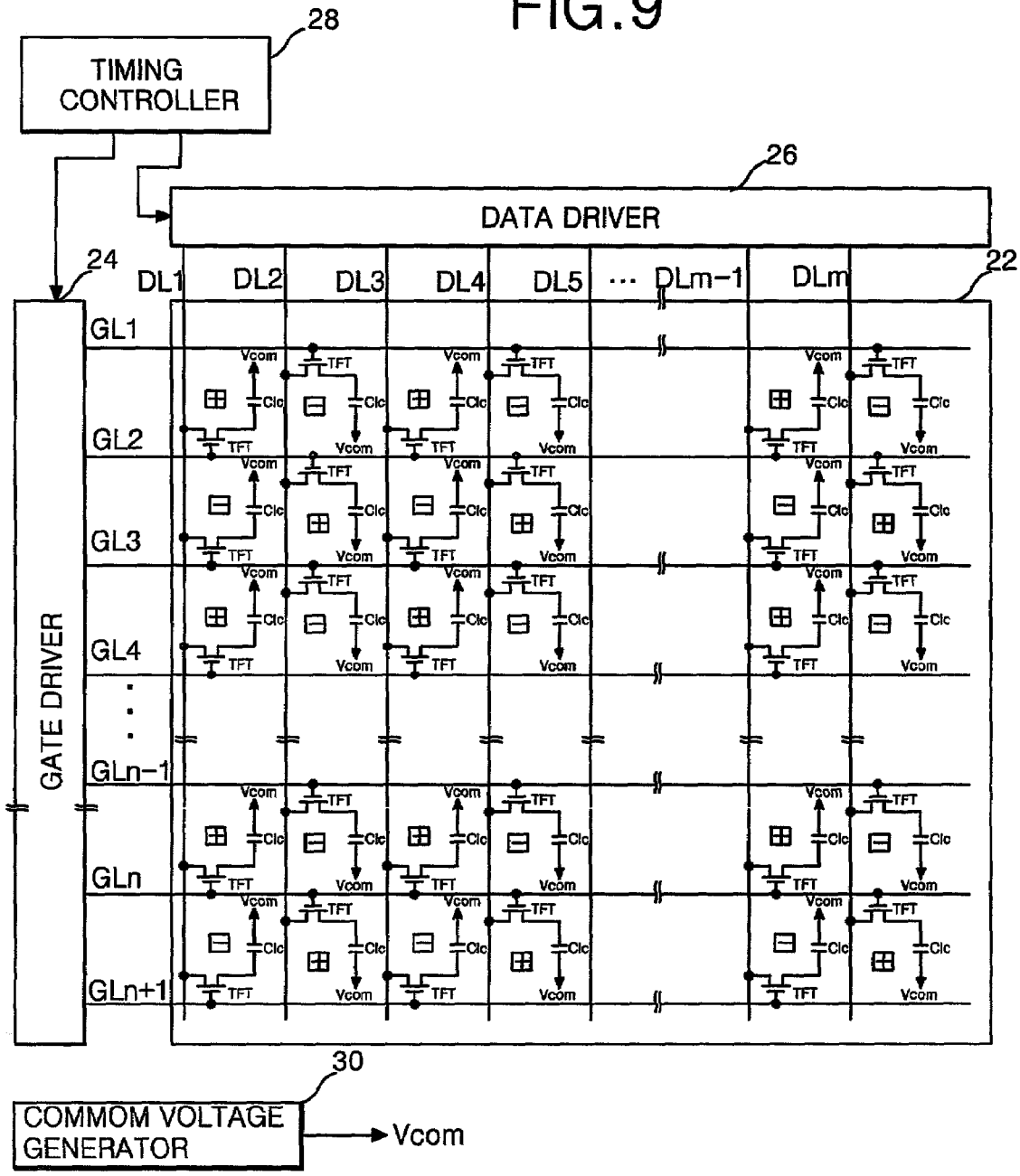
FIG. 9 is a schematic view showing a configuration of a liquid crystal display according to another embodiment of the present invention.

Referring now to FIG. 9, there is shown a liquid crystal display according to another embodiment of the present invention. The liquid crystal display includes a liquid crystal display panel 22 having liquid crystal cells arranged in a matrix, a gate driver 24 for driving gate lines GL1 to GLn+1, a data driver 26 for driving data lines DL1 to DLm, a timing controller 28 for controlling the gate driver 24 and the data driver 26, and a common voltage generator 30 for applying a common voltage Vcom to the liquid crystal display panel 22.

As shown, the liquid crystal display panel 22 includes a plurality of crossing gate lines GL1 to GLn+1 and data lines DL1 to DLm. Liquid crystal cells are provided at areas defined by the intersections of the gate lines (GL1 to GLn+1) and the data lines (DL1 to DLm). Each liquid crystal cell includes a thin film transistor (TFT) that is connected to one of the gate lines (GL1 to GLn+1) and to one of the data lines (DL1 to DLm). A liquid crystal capacitor Clc comprised of a common electrode, a pixel electrode, and an interposed liquid crystal, is also connected to each TFT. Each liquid crystal cell further includes a storage capacitor (not shown) for maintaining the data voltage charged in the liquid crystal capacitor Clc until the next data voltage is charged.

Each TFT applies the pixel voltage signal from the corresponding data line DL in response to a scanning signal, that is, a gate signal, from the corresponding gate line GL. The TFT's are connected in a zigzag pattern along the gate lines (GL1 to GLn+1). Thus, the liquid crystal cells also formed into a zigzag pattern around the gate lines GL1 to GLn+1. In other words, adjacent liquid crystal cells along a horizontal line are connected to adjacent gate lines. As a result, liquid crystal cells in adjacent horizontal rows are driven whenever a gate lines (GL1 to GLn+1) is driven. Furthermore, the liquid crystal cells of each horizontal row are driven by two different gate lines. To this end, the nth gate line GLn is followed by the (n+1) gate line GLn+1.

More specifically, the liquid crystal cells in the even numbered columns, which are connected to even-numbered data lines DL2, DL4, . . . , DLm, are driven by an upper adjacent gate lines (GL1 to GLn), while the liquid crystal cells in the odd numbered columns, which are connected to the odd-numbered data lines DL1, DL3, . . . , DLm−1, are driven by the lower adjacent gate lines GL2 to GLn+1. In other words, the liquid crystal cells in the ith horizontal row that are connected to even numbered columns are driven by the ith gate line Gli, while the liquid crystal cells in the ith horizontal row that are connected to the odd numbered columns are driven by the (i+1)th gate line GLi+1.

For instance, the liquid crystal cells of the first horizontal line that are connected to even numbered columns are driven with the first gate line GL1, while the liquid crystal cells of the first horizontal line that are connected to the odd numbered columns are driven by the second gate line GL2. Furthermore, the liquid crystal cells on the nth horizontal line that are connected to even numbered columns are driven by the nth gate line GL1, while the liquid crystal cells on the nth horizontal line that are connected to odd numbered columns are driven by the (n+1)th gate line GLn+1.

Since the liquid crystal cells are arranged in a zigzag pattern, the liquid crystal display panel 22 is driven by dot inversion when the pixel voltage signals are applied by line inversion.

For instance, when the first gate line GL1 is driven in one frame interval with the polarities shown in FIG. 9, negative (−) pixel voltage signals are charged in the even-numbered liquid crystal cells of the first horizontal line. Further, when the second gate line GL2 is driven, positive (+) pixel voltage signals are charged in both the odd-numbered liquid crystal cells of the first horizontal line and the even-numbered liquid crystal cells of the second horizontal line. Furthermore, when the third gate line GL3 is driven, negative (−) pixel voltage signals are charged in both the odd-numbered liquid crystal cells of the second horizontal line and the even-numbered liquid crystal cells of the third horizontal line. Accordingly, since positive (+) pixel voltage signals, negative (−) pixel voltage signals, negative (−) pixel voltage signals and positive (+) pixel voltage signals are charged in the odd-numbered liquid crystal cells on the first horizontal line, the even-numbered liquid crystal cells of the first horizontal line, the odd-numbered liquid crystal cells of the second horizontal line and the even-numbered liquid crystal cells of the second horizontal line, respectively, the liquid crystal display panel 22 is driven by dot inversion.

Figure 10:
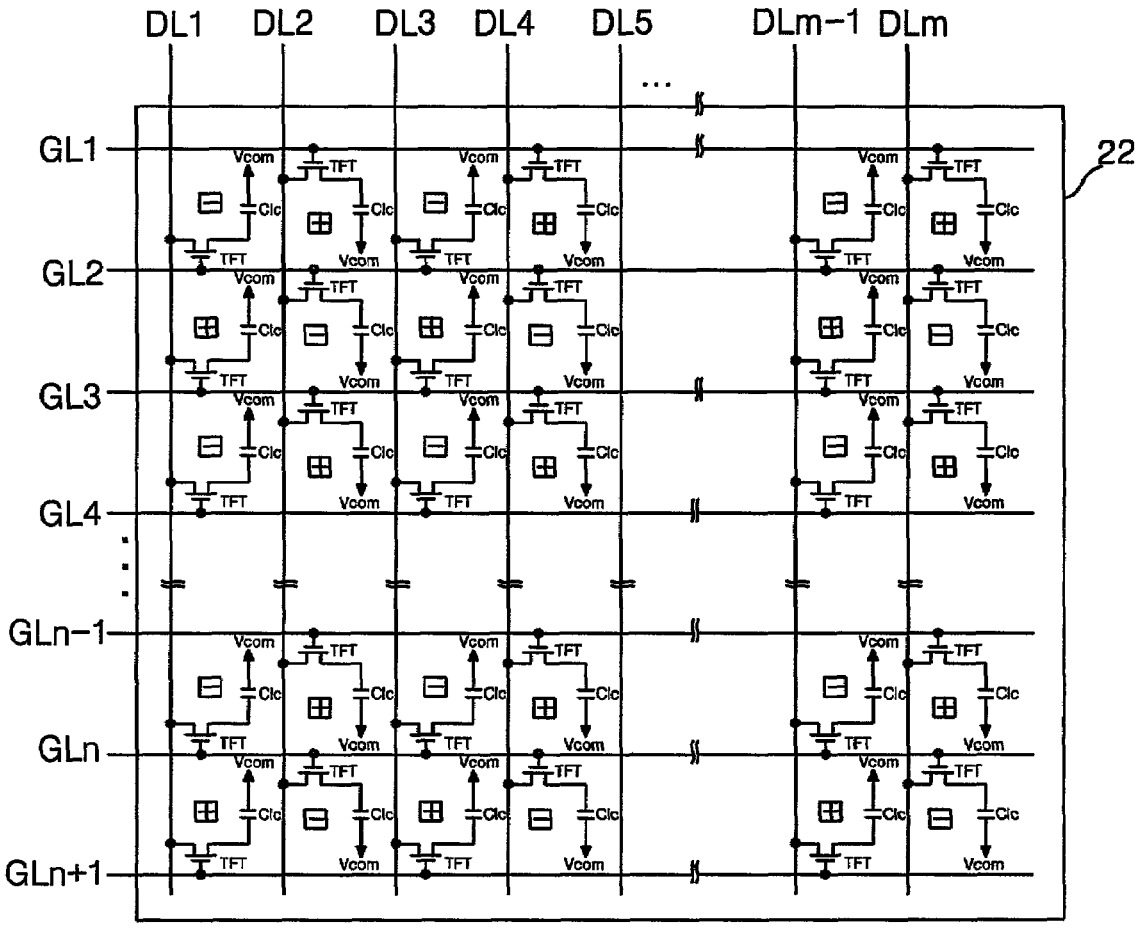
FIG. 10 is a schematic view showing another configuration of the liquid crystal display panel shown in FIG. 9.

Subsequently, during the next frame, when the first gate line GL1 is driven as shown in FIG. 10, positive (+) pixel voltage signals are charged in the even-numbered liquid crystal cells on the first horizontal line. Further, when the second gate line GL2 is driven, negative (−) pixel voltage signals are charged in both the odd-numbered liquid crystal cells of the first horizontal line and the even-numbered liquid crystal cells of the second horizontal line. Furthermore, when the third gate line GL3 is driven, positive (+) pixel voltage signals are charged in both the odd-numbered liquid crystal cells of the second horizontal line and the even-numbered liquid crystal cells of the third horizontal line. Accordingly, since negative (−) pixel voltage signals, positive (+) pixel voltage signals, positive (+) pixel voltage signals and negative (−) pixel voltage signals are charged in the odd-numbered liquid crystal cells of the first horizontal line, the even-numbered liquid crystal cells of the first horizontal line, the odd-numbered liquid crystal cells of the second horizontal line and the even-numbered liquid crystal cells of the second horizontal line, respectively, the liquid crystal display panel 22 is driven by dot inversion.

The gate driver 24 sequentially applies a gate signal, that is, a gate high voltage, to the gate lines GL1 to GLn+1 to drive the TFT's connected to the corresponding gate line.

The data driver 26 converts input pixel data into analog pixel voltage signals that are applied to the data lines (DL1 to DLm) when a gate high voltage is applied to a gate line (GL1 to GLn+1). The data driver 26 converts pixel data into pixel voltage signals with the aid of gamma voltages from a gamma voltage generator (not shown). Furthermore, the data driver 26 applies pixel voltage signals having different polarities in every horizontal period using line inversion to the data lines (DL1 to DLm). Particularly, the data driver 26 applies pixel voltage signals to the liquid crystal cells arranged in a zigzag pattern around the gate lines. To this end, the data driver 26 combines even-numbered (or odd-numbered) pixel data for the current horizontal period and odd-numbered (or even-numbered) pixel data from the previous horizontal period to produce combined pixel data for the data lines (DL1 to DLm). A detailed configuration of the data driver 26 will be provided subsequently.

The timing controller 28 generates control signals for providing a drive control of the gate driver 24 and the data driver 26, and supplies pixel data signals to the data driver 26.

The common voltage generator 30 generates a common voltage Vcom that is applied it to the common electrode, which opposes the pixel electrodes. In order to charge the pixel voltage signals into the liquid crystal cells by line inversion, the data driver 26 supplies pixel voltage signals having the same polarity without a polarity inversion of the pixel voltage signals in every horizontal period, but provides an AC drive to the common voltage Vcom in every horizontal period, reference FIG. 7.

Accordingly, the data driver 26 requires only a positive or a negative gamma voltage set in each horizontal period. For example, in odd horizontal periods, the data driver 26 receives only a positive gamma voltage set (referenced to Vcom) such as gamma voltages GMA1 to GMA9, which correspond to a black gray through a white gray, reference FIG. 7. On the other hand, the data driver 26 inputs a negative gamma voltage set (referenced to Vcom) such as gamma voltages −GMA1, −GMA5 and −GMA9, corresponding to a black gray, a gray, to a white gray reference FIG. 7, in even horizontal periods. Consequently, the range of required gamma voltages is reduced in relation to the conventional art such that analog power consumption is reduced.

Figure 11:
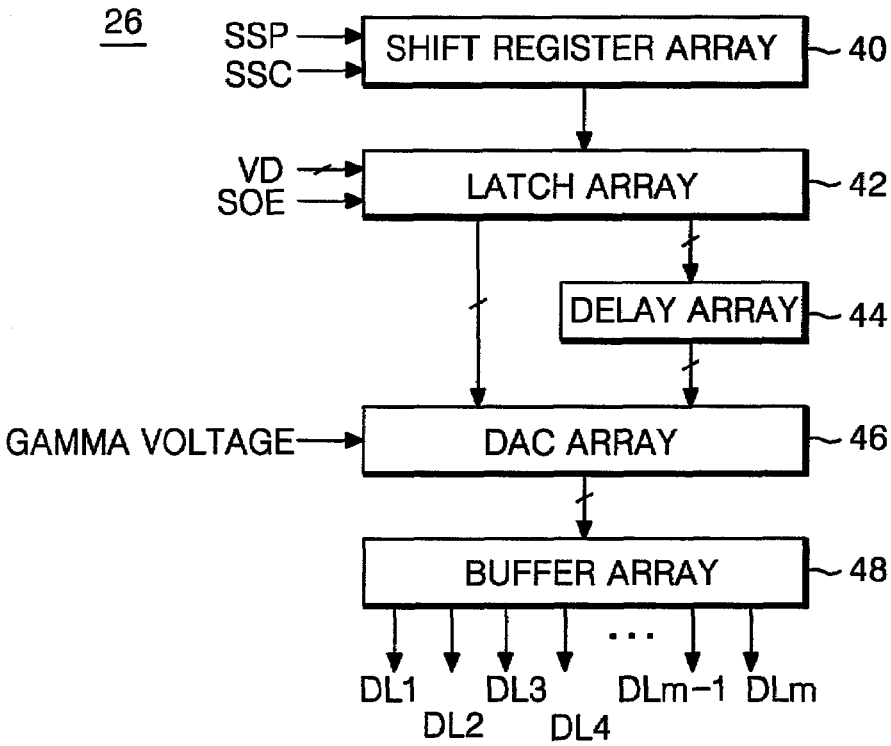
FIG. 11 is a detailed block diagram of the data driver shown in FIG. 9.

FIG. 11 shows a detailed configuration of the data driver 26 in FIG. 9. The data driver 26 includes a shift register array 40 for supplying sequential sampling signals, a latch array 42 for latching and outputting pixel data in response to the sampling signals, a delay array 44 for delaying odd-numbered (or even-numbered) pixel data from the latch array 42, a digital-to-analog converter (DAC) array 46 for converting pixel data from the latch array 42 and the delay array 44 into pixel voltage signals, and a buffer array 48 for buffering and outputting the pixel voltage signals from the DAC array 46.

A plurality of shift registers are included in the shift register array 40 to sequentially shift an input source start pulse SSP from the timing controller 28 in response to a source sampling clock signal SSC to output the shifted signal as a sampling signal.

A plurality of latches are included in the latch array 42 for sample input pixel data VD by a certain unit in response to the sampling signal from the shift register array 40 so as to sequentially latch the sampled pixel data and simultaneously output them in response to a source output enable signal SOE from the timing controller 28.

A plurality of delays is included in the delay array 44 for delaying the odd-numbered (or the even-numbered) pixel data outputted from the latch array 42 by one horizontal period.

A plurality of DACs are included in the DAC array 46 for converting the even-numbered (or the odd-numbered) pixel data from the latch array 42 and the odd-numbered (or the even-numbered) pixel data, which is delayed by one horizontal period by means of the delay array 44, into pixel voltage signals with the aid of gamma voltages from the gamma voltage generator (not shown). Herein, if it is assumed that the common voltage generator 30 generates a fixed common voltage Vcom, then the DAC array 24 outputs pixel voltage signals having different polarities in every horizontal period. Otherwise, if it is assumed that the common voltage generator 30 should generate an AC voltage that alternates in each frame, then the DAC array 24 outputs pixel voltage signals having the same polarity.

The buffer array 48 buffers the pixel voltage signals from the DAC array 48 to produce buffered pixel voltage signals on the data lines DL1 to DLm+1. Herein, the delay array 44 delays the odd-numbered (or the even-numbered) pixel voltage signals by one horizontal period, even when it follows the DAC array 46 or the buffer array 48.

As described above, the liquid crystal display according to another embodiment of the present invention combines odd-numbered (or the even-numbered) pixel voltage signals in a horizontal period with even-numbered (or the odd-numbered) pixel voltage signals from the previous horizontal period to produce combined pixel voltage signals for liquid crystal cells arranged in a zigzag pattern around gate lines. The drivers can produce signals using a line inversion system to drive the liquid crystal display panel 22 by dot inversion. Accordingly, the liquid crystal display according to the present invention drives the liquid crystal display panel 22 by dot inversion system using driving devices (i.e., the timing controller 28, the data driver 26 and the common voltage generator 30) of a line inversion system. This can dramatically reduce power consumption in comparison to driving the liquid crystal panel using prior art dot inversion systems.

Although the present invention has been explained by the embodiments shown in the drawings and described above, it should be understood that the present invention is not limited to the those embodiments, but rather that various changes or modifications thereof are possible without departing from the spirit of the invention. Accordingly, the scope of the invention shall be determined only by the appended claims and their equivalents.

What is claimed is:

1. A liquid crystal display, comprising:

a liquid crystal display panel having liquid crystal cells defined between intersecting gate lines and data lines;

thin film transistors connected in a zigzag pattern to the gate lines; and a liquid crystal display panel driver applying pixel voltage signals to the data lines, wherein the pixel voltage signals on each data line have the same polarity in a horizontal period, wherein the liquid crystal display panel driver includes:

a data driver that converts input pixel data into the pixel voltage signals; and a timing controller that controls the data driver and that combines pixel data in a current horizontal period with pixel data from a previous horizontal period to produce combined pixel data, wherein the input pixel data includes the combined pixel data.

2. The liquid crystal display according to claim 1, further comprising:

a common electrode disposed adjacent to the liquid crystal display panel; and liquid crystal disposed between the common electrode disposed and the liquid crystal display panel, wherein the liquid crystal display panel driver further includes:

a gate driver sequentially driving the gate lines, the gate driver being controlled by the timing controller; and a common voltage generator supplying a common voltage to the common electrode.

3. The liquid crystal display according to claim 2, wherein:

the data driver converts input pixel data into pixel voltage signals into pixel voltage signals used in a line inversion system; and the common voltage generator supplies an AC common voltage to the common electrode;

the timing controller controls the gate driver.

4. The liquid crystal display according to claim 1, wherein odd-numbered liquid crystal cells of the ith horizontal line (wherein i is an integer) are connected to the ith gate line, and wherein even-numbered liquid crystal cells of the ith horizontal line are connected to the (i+1)th gate line.

5. The liquid crystal display according to claim 1, wherein even-numbered liquid crystal cells of the liquid crystal cells on the ith horizontal line (wherein i is an integer) are connected to the ith gate line, and wherein odd-numbered liquid crystal cells on the ith horizontal line are connected to the (i+1)th gate line.

6. The liquid crystal display according to claim 1, wherein the timing controller combines odd-numbered pixel data of a horizontal period with even-numbered pixel data from a previous horizontal period, to produce the combined input pixel data, wherein the even-numbered pixel data is delayed by one horizontal period.

7. The liquid crystal display according to claim 1, wherein the timing controller combines even-numbered pixel data of a horizontal period with odd-numbered pixel data from a previous horizontal period, to produce the combined input pixel data, wherein the odd-numbered pixel data is delayed by one horizontal period.

8. The liquid crystal display according to claim 1, wherein the timing controller includes:

a pixel data aligner dividing odd-numbered pixel data from even-numbered pixel data, wherein one of the divided odd- and even-numbered pixel data is applied to the data driver as the pixel data in the current horizontal period; and a line memory coupled between the pixel data aligner and the data driver, the line memory storing the other of the divided odd- and even-numbered pixel data for one horizontal period as the pixel data from the previous horizontal period.

9. The liquid crystal display according to claim 8, wherein the line memory stores odd-numbered pixel data for one horizontal period.

10. The liquid crystal display according to claim 8, wherein the line memory stores even-numbered pixel data for one horizontal period.

11. A liquid crystal display, comprising:

a liquid crystal display panel having liquid crystal cells defined between intersecting gate lines and data lines;

thin film transistors connected in a zigzag pattern to the gate lines; and a liquid crystal display panel driver applying pixel voltage signals to the data lines, wherein the pixel voltage signals on each data line has the same polarity in a horizontal period, wherein the liquid crystal display panel driver includes:

a data driver that combines pixel data in a current horizontal period with pixel data in a previous horizontal period to produce combined pixel data and that converts the combined pixel data into pixel voltage signals that are applied to the data lines; and a timing controller that controls the data driver and that supplies pixel data to the data driver.

12. The liquid crystal display according to claim 11, wherein the data driver combines odd-numbered pixel data of one horizontal line with even-numbered pixel data that is delayed by one horizontal period to produce the combined pixel data.

13. The liquid crystal display according to claim 11, wherein the data driver combines even-numbered pixel data of one horizontal line with odd-numbered pixel data that is delayed by one horizontal period to produce the combined pixel data.

14. The liquid crystal display according to claim 11, wherein the data driver includes:

a shift register array that applies sequential sampling signals;

a latch array that latches and outputs pixel data in response to the sequential sampling signals;

a digital-to-analog converter array that converts pixel data into pixel voltage signals;

a buffer array that buffers pixel voltage signals and outputs buffered pixel voltage signals; and a delay array that delays odd-numbered pixel data by one horizontal period.

15. The liquid crystal display according to claim 11, wherein the data driver includes:

a shift register array that applies sequential sampling signals;

a latch array that latches and outputs pixel data in response to the sequential sampling signals;

a digital-to-analog converter array that converts pixel data into pixel voltage signals;

a buffer array that buffers pixel voltage signals and outputs buffered pixel voltage signals; and a delay array that delays even-numbered pixel data by one horizontal period.

16. The liquid crystal display according to claim 11, wherein odd-numbered liquid crystal cells of the ith horizontal line (wherein i is an integer) are connected to the ith gate line, and wherein even-numbered liquid crystal cells of the ith horizontal line are connected to the (i+1)th gate line.

17. The liquid crystal display according to claim 11, wherein even-numbered liquid crystal cells of the liquid crystal cells on the ith horizontal line (wherein i is an integer) are connected to the ith gate line, and wherein odd-numbered liquid crystal cells on the ith horizontal line are connected to the (i+1)th gate line.

18. The liquid crystal display according to claim 11, further comprising:

a common electrode disposed adjacent to the liquid crystal display panel; and liquid crystal disposed between the common electrode disposed and the liquid crystal display panel, wherein the liquid crystal display panel driver further includes:

a gate driver sequentially driving the gate lines, the gate driver controlled by the timing controller; and a common voltage generator supplying a common voltage to the common electrode.

19. The liquid crystal display according to claim 18, wherein the:

the data driver produces combined pixel voltage signals used in a line inversion system;

the common voltage generator supplies an AC voltage to the common electrode; and the timing controller controls the gate driver.

20. A method of driving a liquid crystal display, comprising the steps of:

combining pixel data in a current horizontal period with pixel data in a previous horizontal period to produce combined pixel data in every horizontal period; and applying the combined pixel data to liquid crystal cells that are connected together in a zigzag pattern.

21. The method according to claim 20, wherein, said step of combining pixel data includes combining odd-numbered pixel data of a current horizontal line with even-numbered pixel data that is delayed by one horizontal period.

22. The method according to claim 20, wherein, said step of combining pixel data includes combining even-numbered pixel data of a current horizontal line with odd-numbered pixel data that is delayed by one horizontal period.

* * * * *